US011019846B2

(12) United States Patent
Ding

(10) Patent No.: US 11,019,846 B2
(45) Date of Patent: Jun. 1, 2021

(54) ELECTRONIC CIGARETTE ATOMIZATION CORE AND ELECTRONIC CIGARETTE ATOMIZER

(71) Applicant: Shenzhen Jianan Technology Co., Limited, Guangdong (CN)

(72) Inventor: Jianjun Ding, Guangdong (CN)

(73) Assignee: SHENZHEN JIANAN TECHNOLOGY CO., LIMITED, Shenzhen (CN)

( * ) Notice: Subject to any disclaimer, the term of this patent is extended or adjusted under 35 U.S.C. 154(b) by 316 days.

(21) Appl. No.: 16/093,968

(22) PCT Filed: May 31, 2017

(86) PCT No.: PCT/CN2017/086634

§ 371 (c)(1),
(2) Date: Oct. 15, 2018

(87) PCT Pub. No.: WO2018/218517

PCT Pub. Date: Dec. 6, 2018

(65) Prior Publication Data

US 2020/0345074 A1 Nov. 5, 2020

(51) Int. Cl.
*A24F 13/00* (2006.01)
*A24F 17/00* (2006.01)
(Continued)

(52) U.S. Cl.
CPC ..... *A24F 40/46* (2020.01); *A24F 40/42* (2020.01); *A24F 40/10* (2020.01); *A24F 40/485* (2020.01)

(58) Field of Classification Search
CPC ..... A24F 47/008; A24F 47/002; A24F 40/46; A24F 40/40
(Continued)

(56) References Cited

U.S. PATENT DOCUMENTS 7,726,320 B2 * 6/2010 Robinson ..... H05B 3/42 131/200
9,591,876 B2 * 3/2017 Alima ..... A24F 47/008
(Continued)

FOREIGN PATENT DOCUMENTS

CN 203884698 U 10/2014
CN 204070571 U 1/2015
CN 206043424 U 3/2017

*Primary Examiner* — Hae Moon Hyeon

(57) ABSTRACT

An electronic cigarette atomization core comprising an atomizing core body, and the atomizing core body is provided with an e-liquid storage chamber for receiving e-liquid and a heating chamber for accommodating the heating element, the heating element is abutted against an outer wall of one end of the e-liquid storage chamber for transferring heat to the e-liquid in the e-liquid storage chamber to atomize the e-liquid when the heating element generates heat, the e-liquid storage chamber and the heating chamber are disconnected to each other; the atomizing core body further comprises a heat insulating bracket sleeved between the e-liquid storage chamber and the heating chamber for thermally insulating the e-liquid storage chamber when the heating element generates heat. The present invention achieves that the smoke atomized by the electronic cigarette atomization core is pure in taste, has no risk of inhaling metal ions, and is healthy.

11 Claims, 5 Drawing Sheets

(51) Int. Cl.

| | |
|---|---|
| ***A24F 25/00*** | (2006.01) |
| ***A24F 40/46*** | (2020.01) |
| ***A24F 40/42*** | (2020.01) |
| *A24F 40/485* | (2020.01) |
| *A24F 40/10* | (2020.01) |

(58) Field of Classification Search
USPC ..... 131/328, 329
See application file for complete search history.

(56) References Cited

U.S. PATENT DOCUMENTS

| | | | | |
|---|---|---|---|---|
| 10,517,331 | B2 * | 12/2019 | Atkins | A24F 40/46 |
| 2008/0092912 | A1 * | 4/2008 | Robinson | A24F 40/40 131/200 |
| 2014/0314397 | A1 * | 10/2014 | Alima | A24F 47/008 392/386 |
| 2018/0000160 | A1 * | 1/2018 | Taschner | H05B 3/44 |
| 2018/0084823 | A1 * | 3/2018 | Fuisz | A24F 47/002 |
| 2018/0098577 | A1 * | 4/2018 | Frobisher | H05B 3/0071 |
| 2020/0120989 | A1 * | 4/2020 | Danek | A61M 15/0023 |

* cited by examiner

ELECTRONIC CIGARETTE ATOMIZATION CORE AND ELECTRONIC CIGARETTE ATOMIZER

FIELD OF THE PRESENT APPLICATION

The present application relates to a field of electronic cigarette devices, and more particularly relates to an electronic cigarette atomization core and an electronic cigarette atomizer.

BACKGROUND OF THE PRESENT APPLICATION

As people pay more attention to their own health and importance of social external environment, especially indoor environmental pollution, smoking cessation is imperative. In order to solve an excessive dependence on traditional cigarettes, an electronic cigarette atomizer is produced.

In electronic cigarette atomizer of the prior art, the smoke formed by e-liquid atomized by hot air heated by a heating wire flows into a user's mouth, the smoke taste is irritating and hot, and as the airflow may pass through the heating wire, so there may be a risk of an inhalation of metal ions, which can affect the health of the user.

Therefore, it is an urgent need to solve the problem of the atomization core and the atomizer by designing an electronic cigarette atomization core and an electronic cigarette atomizer to ensure that atomization efficiency is improved, atomization of the smoke is purely soft and the inhalation of metal ions that affects the health of the user can be avoided.

SUMMARY OF THE PRESENT APPLICATION

By providing an electronic cigarette atomization core and an electronic cigarette atomizer, the present application solves the problem that the atomization core and the atomizer in the prior art cannot ensure an improvement of the atomization efficiency while a smoke mouth feel is moderated to improve an user experience, and an inhalation of metal ions may be presented to affect the health of the user, and realizes technical effects that smoke atomized by the atomization core is pure and it can prevent the inhalation of the metal ions affecting the health of the user.

On one aspect, the present application provides an electronic cigarette atomization core for atomizing e-liquid to form smoke for a user to inhale, comprising an atomizing core body, and the atomizing core body is provided with an e-liquid storage chamber for receiving e-liquid and a heating chamber for accommodating a heating element, the heating element is abutted against an outer wall of one end of the e-liquid storage chamber for transferring heat to the e-liquid in the e-liquid storage chamber to atomize the e-liquid when the heating element generates heat, the e-liquid storage chamber and the heating chamber are disconnected to each other; and The atomizing core body further comprises a heat insulating bracket sleeved between the e-liquid storage chamber and the heating chamber for thermally insulating the e-liquid storage chamber when the heating element generates heat.

Typically, an e-liquid reservoir is axially defined in the atomizing core body, and the e-liquid storage chamber is formed in the e-liquid reservoir, the e-liquid reservoir comprises an open end, and the heating element in a spiral shape and abuts against an outer end wall of the e-liquid reservoir opposite to the open end; and An end of the heat insulating bracket opposite to the heating element is an open end and is connected with a first fixing member, and one end of the first fixing member is abutted against the e-liquid reservoir and an end wall of an open end of the heat insulating bracket, respectively; the other end of the first fixing member is clamped between a side wall of e-liquid reservoir and a side wall of the heat insulating bracket, so that the e-liquid reservoir is spaced apart with the heat insulating bracket to form a first space for thermal insulation, the heating chamber is defined inside the first space.

Typically, the first fixing member is sleeved by a second fixing member, and the second fixing member is respectively abutted against an end wall of the open end of the e-liquid reservoir, an outer side wall of an open end of the heat insulating bracket, and the first fixing member for fixing the first fixing member between the e-liquid reservoir and the heat insulating bracket and for fixing the e-liquid reservoir inside the heat insulating bracket.

Typically, an inner wall of the heat insulating bracket is inwardly and radially shrunk to form a limiting step, and the limiting step abuts against a first sleeve ring; and A support barrel is further defined in an end of the heat insulating bracket opposite to the first fixing member, the support barrel comprises an open end and an annular end wall of the open end is abutted against a first sleeve ring, an outer end wall of the other end of the support barrel abuts against the heating element to fix the heating element between the support barrel and the e-liquid reservoir, the heating chamber is formed between the support barrel and the e-liquid reservoir.

Typically, the heating element comprises a first connecting pin and a second connecting pin for an electrical connection, a first through hole, a first connecting hole and a second connecting hole are defined at an end wall of the support barrel abutted against the heating element, and the first connecting hole and the second connecting hole are configured to pass through the first connecting pin and the second connecting pin, respectively.

Typically, an e-liquid reservoir is axially defined in the atomizing core body, and the e-liquid reservoir comprises an open end, the e-liquid storage chamber is formed in the e-liquid reservoir and adjacent to the open end of the e-liquid reservoir, and the heating chamber is formed in the e-liquid reservoir and is positioned opposite to the open end of the e-liquid reservoir, a partition plate for isolating the e-liquid storage chamber and the heating chamber is defined in the e-liquid reservoir, and the heating element is in a spiral shape and is abutted against an inner end wall of the e-liquid reservoir opposite to the open end.

Typically, an inner wall of the heat insulating bracket is inwardly and radially shrunk to form a limiting step, and the limiting step abuts against a first sleeve ring; and A support barrel is further defined in the heat insulating bracket, the support barrel comprises an open end and an annular end wall of the open end is abutted against a first sleeve ring, an end wall of the other end of the support barrel partially extends toward the e-liquid reservoir to form an annular projection, and the annular projection is abutted against an end wall of the e-liquid reservoir opposite to the open end.

Typically, the heating element comprises a first connecting pin and a second connecting pin for an electrical connection, a third connecting hole and a fourth connecting hole are provided on an end wall of the e-liquid reservoir opposite to the open end, the third connecting hole and the fourth connecting hole are configured to pass through the first connecting foot and the second connecting foot of the heating element, respectively; a fifth connecting hole and a sixth connecting hole are defined at an end wall of the support barrel adjacent to the e-liquid reservoir, the fifth connecting hole and the sixth connecting hole are configured to pass through the first connecting pin and the second connecting pin of the heating element.

Typically, one end of the heat insulating bracket opposite to the first fixing member is radially shrunk and axially extended opposite to the first fixing member to form a first external electrode, the first external electrode is provided with a first internal electrode, a first insulating ring is sleeved between the first external electrode and the first internal electrode; and A first connecting pin of the heating element is electrically connected to the first external electrode through the first connecting hole, and a second connecting pin of the heating element is electrically connected to the first internal electrode through the second connecting hole.

On a further aspect, the present application further provides an electronic cigarette atomizer, comprising the electronic cigarette atomization core, the atomizer comprises an outer casing sleeved outside the atomization core, a nozzle assembly defined at one end of the outer casing, the outer casing is spaced apart with the heat insulating bracket of the atomization core to form an airflow passage for air to flow, smoke generated by atomization of the e-liquid in the e-liquid storage chamber enters the airflow passage, mixes with air and flows to the nozzle assembly.

Typically, one end of the nozzle assembly is provided with a smoke outlet and internally provided with a first chamber communicated with the smoke outlet, the other end of the nozzle assembly extends axially opposite to the smoke outlet to an internal portion of the outer casing to form an embedding portion, a side wall of the embedding portion is provided with a vent, and the smoke outlet and the first chamber are communicated with the airflow passage through the vent.

Typically, an end of the outer casing opposite to the nozzle assembly is further provided with a connecting portion for connecting to the battery assembly, the connecting portion comprises a first connecting portion abutting against an end wall of the outer casing, and a second connecting portion inserted into an inner portion of the outer casing;

A center of the first connecting portion is axially extended in a direction opposite to the nozzle assembly to form a second external electrode, and a center of the connecting portion is provided with an accommodating space sequentially penetrating the first connecting portion and the second connecting portion; and One end of the accommodating space near the second external electrode is provided with a second internal electrode, and a second insulating ring is sleeved between the second external electrode and the second internal electrode.

Typically, a side wall of the first connecting portion is provided with a plurality of first air intake passages, and an internal portion of the second connecting portion is provided with a plurality of second air intake passages along an axial direction of the outer casing, each of the second air intake passages is in communication with each of the first air intake passages, and each of the first air intake passages S2, each of the second air intake passages, the airflow passage, the first chamber and the smoke outlet are sequentially communicated.

Typically, an outer side wall of the second connecting portion is provided with an annular groove, and a second sleeve ring is elastically clamped in the annular groove, the second sleeve ring is elastically and respectively abutted against the annular groove and an inner side wall of the outer casing to achieve a fixed connection of the connecting portion and the outer casing.

Typically, the first external electrode of the atomization core is inserted into one end of the accommodating space toward the nozzle assembly, the first external electrode is electrically connected to the second external electrode, and the first internal electrode of the atomization core is electrically connected to the second internal electrode.

One or more technical solutions provided in embodiments of the present application have at least following technical effects or advantages: by making the heating chamber provided with the heating element and the e-liquid storage chamber accommodating the e-liquid be disconnected to each other, the smoke obtained by the atomization is purely soft to improve the user experience and it can prevent the inhalation of metal ions from affecting the health of the user.

BRIEF DESCRIPTION OF THE DRAWINGS

In order to more clearly illustrate the embodiments of the present application or the technical solutions in the prior art, the drawings used in the embodiments or the description of the prior art will be briefly described below. Obviously, the drawings in the following description are only It is an embodiment of the present application, and those skilled in the art can obtain other drawings according to the provided drawings without any creative work.

DETAILED DESCRIPTION OF THE PREFERRED EMBODIMENT

The embodiment of the present application provides an electronic cigarette atomization core and an atomizer. The specific idea is as follows: by making the heating chamber provided with the heating element and the e-liquid storage chamber accommodating the e-liquid be disconnected to each other, smoke obtained by the atomization is purely soft to improve the user experience and it can prevent the inhalation of metal ions from affecting the health of the user; by setting the heating element in a spiral shape to increase a contact surface of the heating element and the e-liquid storage chamber, so as to effectively improve atomization efficiency.

For well understanding of the above technical solutions, the above technical solutions will be described in detail in conjunction with the drawings and typical embodiments. It should be understood that embodiments and specific features of the embodiments of the present application are detailed descriptions to the technical solutions of the present application, rather than limitations of the technical solutions of the present application. In case of no conflicts, the embodiments and specific features of the embodiments of the present application may be combined with each other.

First Embodiment

Figure 1:
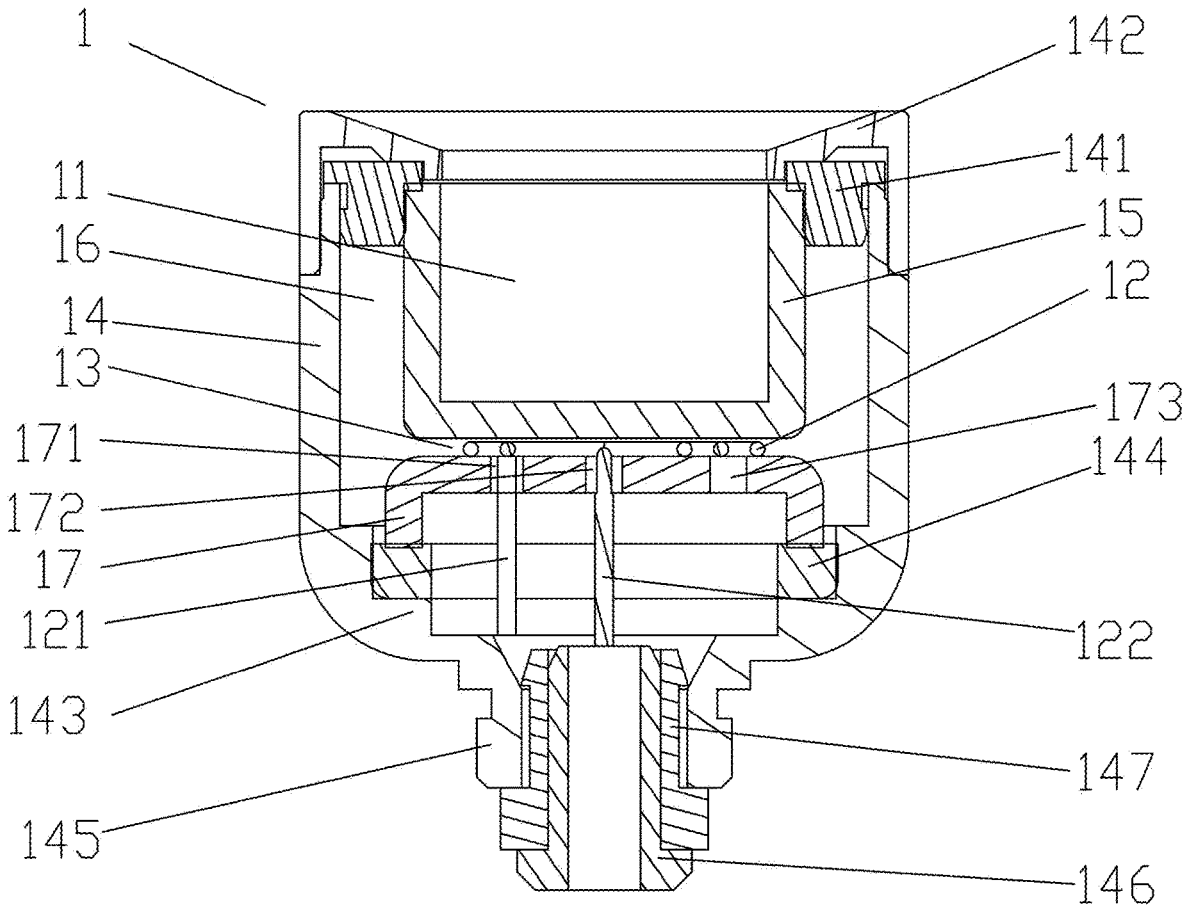
FIG. 1 is a schematic structural view of an electronic cigarette atomization core according to a first embodiment of the present application.

Referring to FIG. 1, an embodiment of the present application provides an electronic cigarette atomization core for atomizing e-liquid to form smoke for a user to inhale, comprising an atomizing core body 1, and the atomizing core body 1 is provided with an e-liquid storage chamber 11 for receiving e-liquid and a heating chamber 13 for accommodating a heating element 12, in a specific implementation process, the e-liquid storage chamber 11 may also be provided with e-liquid storage cotton, the heating element 12 is abutted against an outer wall of one end of the e-liquid storage chamber 11 for transferring heat to the e-liquid in the e-liquid storage chamber 11 to atomize the e-liquid when the heating element 12 generates heat, the e-liquid storage chamber 11 and the heating chamber 13 are disconnected to each other, so that smoke flowing into the mouth of the user does not pass through the heating element 12, thereby avoiding the risk of inhaling metal ions to affect the health of the user; the atomizing core body 1 further comprises a heat insulating bracket 14 sleeved between the e-liquid storage chamber 11 and the heating chamber 13 for thermally insulating the e-liquid storage chamber 11 when the heating element 12 generates heat. In the present embodiment, the heat insulating bracket 14 is made of a conductive material such as metal, and has a certain strength and can also be configured for electrical conduction.

In the present embodiment, an e-liquid reservoir 15 is axially defined in the atomizing core body 1, and the e-liquid storage chamber 11 is formed in the e-liquid reservoir 15, the e-liquid reservoir 15 comprises an open end, and the heating element 12 is in a spiral shape and is abutted against an outer end wall of the e-liquid reservoir 15 opposite to the open end, and the spiral shape design increases a contact area of the heating element 12 and the e-liquid storage chamber 11, thereby effectively improving atomization efficiency of the e-liquid; The e-liquid reservoir 15 is typically made of a glass material, at the same time of heat conduction, heat of the heating element 12 can be radiated to the e-liquid in the e-liquid storage chamber 11 by heat radiation to improve the atomization efficiency.

In order to space the e-liquid reservoir 15 and the heat insulating bracket 14, an end of the heat insulating bracket 14 opposite to the heating element 12 is an open end and is connected with a first fixing member 141, and one end of the first fixing member 141 is abutted against the e-liquid reservoir 15 and an end wall of the open end of the heat insulating bracket 14, respectively; the other end of the first fixing member 141 is clamped between a side wall of the e-liquid reservoir 15 and a side wall of the heat insulating bracket 14, so that the heating chamber 13 is spaced apart with the heat insulating bracket 14 to form a first space 16 for thermal insulation, the heating chamber 13 is defined inside the first space 16. Air in the first space 16 is heated by the heating element 12, so that a side wall of the e-liquid storage chamber 11 can also transfer heat of the heating element 12 to atomize the e-liquid, and the thermal insulation can further improve the atomization efficiency.

In order to fix the e-liquid reservoir 15 to the inside of the heat insulating bracket 14, the first fixing member 141 is sleeved by a second fixing member 142, and the second fixing member 142 is respectively abutted against an end wall of the open end of the e-liquid reservoir 15, an outer side wall of the open end of the heat insulating bracket 14, and the first fixing member 141 for fixing the first fixing member 141 between the e-liquid reservoir 15 and the heat insulating bracket 14 and for fixing the e-liquid reservoir 15 to an internal part of the heat insulating bracket 14. The first fixing member 141 is made of an elastically thermal insulation material, and the second fixing member 142 is made of a thermal insulation material to further have a sealing and thermally insulating effect.

Specifically, an inner wall of the heat insulating bracket 14 is inwardly and radially shrunk to form a limiting step 143, and the limiting step 143 abuts against a first sleeve ring 144; a support barrel 17 is further defined in an end of the heat insulating bracket 14 opposite to the first fixing member 141, the support barrel 17 comprises an open end and an annular end wall of the open end is abutted against a first sleeve ring 144, an outer end wall of the other end of the support barrel 17 abuts against the heating element 12 to fix the heating element 12 between the support barrel 17 and the e-liquid reservoir 15, the heating chamber 13 is formed between the support barrel 17 and the e-liquid reservoir 15. In this embodiment, the first sleeve ring 144 can be made of an elastically thermal insulation material, so that the support barrel 17 can fasten the heating element 12 to an outer wall of the bottom of the e-liquid reservoir 15. The support barrel 17 is made of a thermal insulation material to prevent the heat of the heating element 12 from dissipating along the support barrel 17 to the outside of the heat insulating bracket 14.

As shown in FIG. 1, the heating element 12 comprises a first connecting pin 121 and a second connecting pin 122 for an electrical connection, a first through hole 173, a first connecting hole 171 and a second connecting hole 172 are defined at an end wall of the support barrel 17 abutted against the heating element 12, and the first connecting hole 171 and the second connecting hole 172 are configured to pass through the first connecting pin 121 and the second connecting pin 122, respectively. One end of the heat insulating bracket 14 opposite to the first fixing member 141 is reduced in diameter and axially extends opposite to the first fixing member 141 to form a first external electrode 145, the first external electrode 145 is a hollow structure, the first external electrode 145 is provided with a first internal electrode 146, a first insulating ring 147 is sleeved between the first external electrode 145 and the first internal electrode 146; a first connecting pin 121 of the heating element 12 is electrically connected to the first external electrode 145 through the first connecting hole 171, and a second connecting pin of the heating element 12 is electrically connected to the first internal electrode 146 through the second connecting hole 172. The arrangement of the first connecting hole 171 and the second connecting hole 172 prevents the first connecting pin 121 and the second connecting pin 122 from being contacted with each other and resulted in a short circuit during a transportation or vibration of the atomization core.

Second Embodiment

The atomization core in the second embodiment of the present application is different from the atomization core in the first embodiment in a position of the heating element 12, a structure of the e-liquid reservoir 15, and a structure of the support barrel 17.

Figure 2:
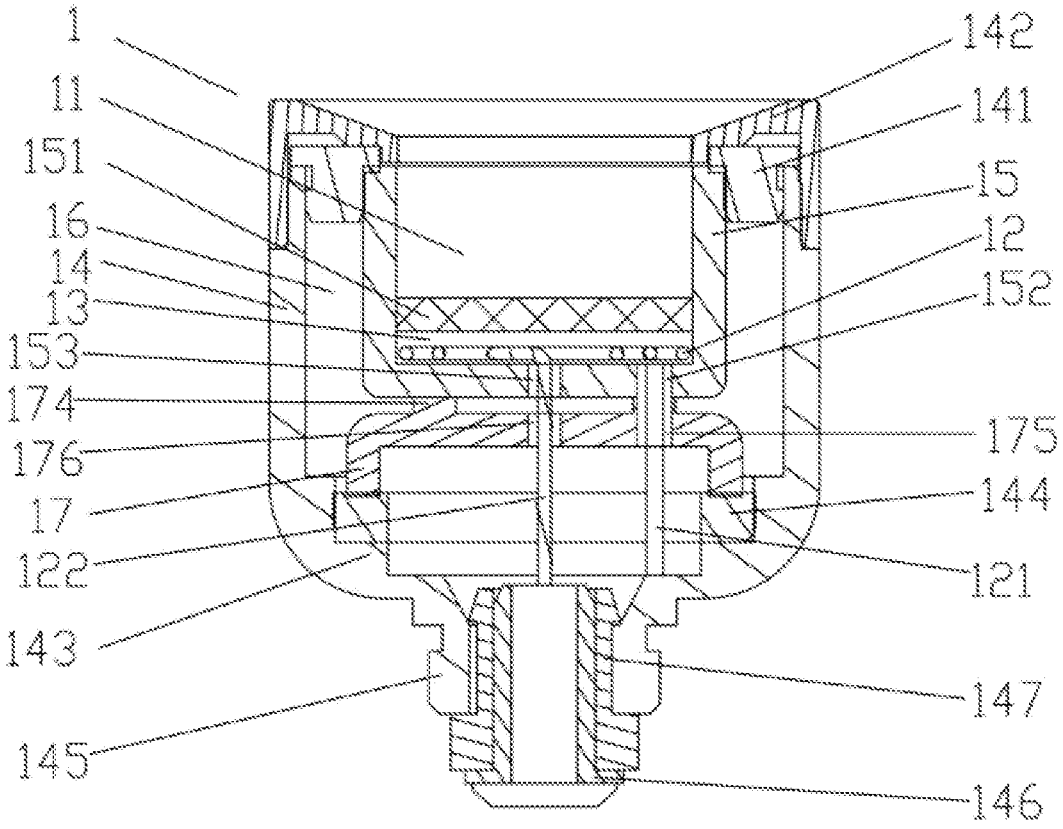
FIG. 2 is a schematic structural view of an electronic cigarette atomization core according to a second embodiment of the present application.

As shown in FIG. 2, in the present embodiment, an e-liquid reservoir 15 is axially defined in the atomizing core body 1, and the e-liquid reservoir 15 comprises an open end, the e-liquid storage chamber 11 is formed in the e-liquid reservoir 15 and adjacent to the open end of the e-liquid reservoir 15, and the heating chamber 13 is formed in the e-liquid reservoir 15 and is positioned opposite to the open end of the e-liquid reservoir 15, a partition plate 151 for isolating the e-liquid storage chamber 11 and the heating chamber 13 is defined in the e-liquid reservoir 15, and the heating element 12 is in a spiral shape and is abutted against an inner end wall of the e-liquid reservoir 15 opposite to the open end. The e-liquid reservoir 15 and the partition plate 151 are typically made of a glass material. Heat of the heat generating element 12 can also be radiated to the e-liquid in the e-liquid storage chamber 11 by heat radiation to improve the atomization efficiency.

Structures of the first fixing member 141 and the second fixing member 142 in this embodiment is the same as those of the first embodiment, and will not be described in detail herein.

Specifically, an inner wall of the heat insulating bracket 14 is inwardly and radially shrunk to form a limiting step 143, and the limiting step 143 abuts against a first sleeve ring 144; a support barrel 17 is further defined in the heat insulating bracket 14, the support barrel 17 comprises an open end and an annular end wall of the open end is abutted against a first sleeve ring 144, an end wall of the other end of the support barrel 17 partially extends toward the e-liquid reservoir 15 to form an annular projection 174, and the annular projection 174 is abutted against an end wall of the e-liquid reservoir 15 opposite to the open end. The support barrel 17 is made of a thermal insulation material to prevent the heat of the heating element 12 from dissipating along the support barrel 17 to the outside of the heat insulating bracket 14. The arrangement of the annular projection 174 reduces a contact area between the support barrel 17 and the e-liquid reservoir 15, and further functions as a thermal insulator.

Specifically, the heating element 12 comprises a first connecting pin 121 and a second connecting pin 122 for an electrical connection, a third connecting hole 152 and a fourth connecting hole 153 are provided on an end wall of the e-liquid reservoir 15 opposite to the open end, the third connecting hole 152 and the fourth connecting hole 153 are configured to pass through the first connecting foot 121 and the second connecting foot 122 of the heating element 12, respectively; a fifth connecting hole 175 and a sixth connecting hole 176 are defined at an end wall of the support barrel 17 near the e-liquid reservoir 15, the fifth connecting hole 175 and the sixth connecting hole 176 are configured to pass through the first connecting pin 121 and the second connecting pin 122 of the heating element 12. The arrangement of the third connecting hole 152, the fourth connecting hole 153, the fifth connecting hole 175 and the sixth connecting hole 176 prevents the first connecting pin 121 and the second connecting pin 122 from being contacted with each other and resulted in a short circuit during a transportation or vibration of the atomization core.

Arrangements of the first external electrode 145, the first internal electrode 146 and the first insulating ring 147 in this embodiment is the same as those in the first embodiment, and will not be described in detail herein.

Third Embodiment

The third embodiment of the present application provides an atomizer comprising the atomization core described in the first embodiment.

Figure 3:
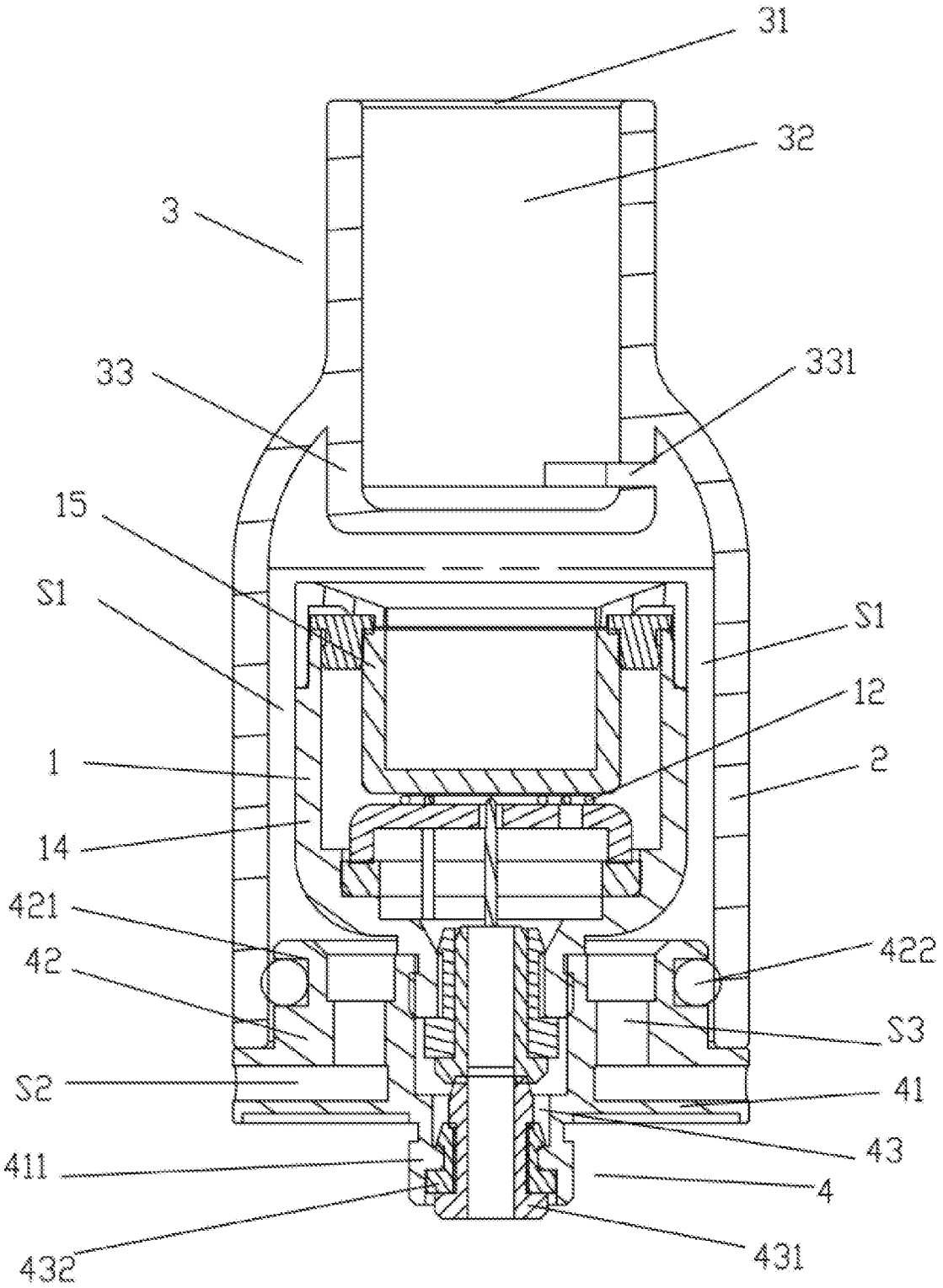
FIG. 3 is a schematic structural diagram of an electronic cigarette atomizer according to a third embodiment of the present application.

As shown in FIG. 3, the atomizer comprises an outer casing 2 sleeved outside the atomization core, a nozzle assembly 3 defined at one end of the outer casing 2, in order to reduce irritation and hot burning degree of highly atomized e-liquid, the outer casing 2 is spaced apart with the heat insulating bracket 14 of the atomization core to form an airflow passage S1 for air to flow, smoke generated by atomization of the e-liquid in the e-liquid storage chamber 11 enters the airflow passage S1, mixes with air and flows to the nozzle assembly 3, and the arrangement of the airflow passage S1 further acts as a thermal insulator.

Specifically, one end of the nozzle assembly 3 is provided with a smoke outlet 31 and internally provided with a first chamber 32 communicated with the smoke outlet 31, the other end of the nozzle assembly 3 extends axially opposite to the smoke outlet 31 to an internal portion of the outer casing 2 to form an embedding portion 33, a side wall of the embedding portion 33 is provided with a vent 331, and the smoke outlet 31 and the first chamber 32 are communicated with the airflow passage S1 through the vent 331.

Figure 4:
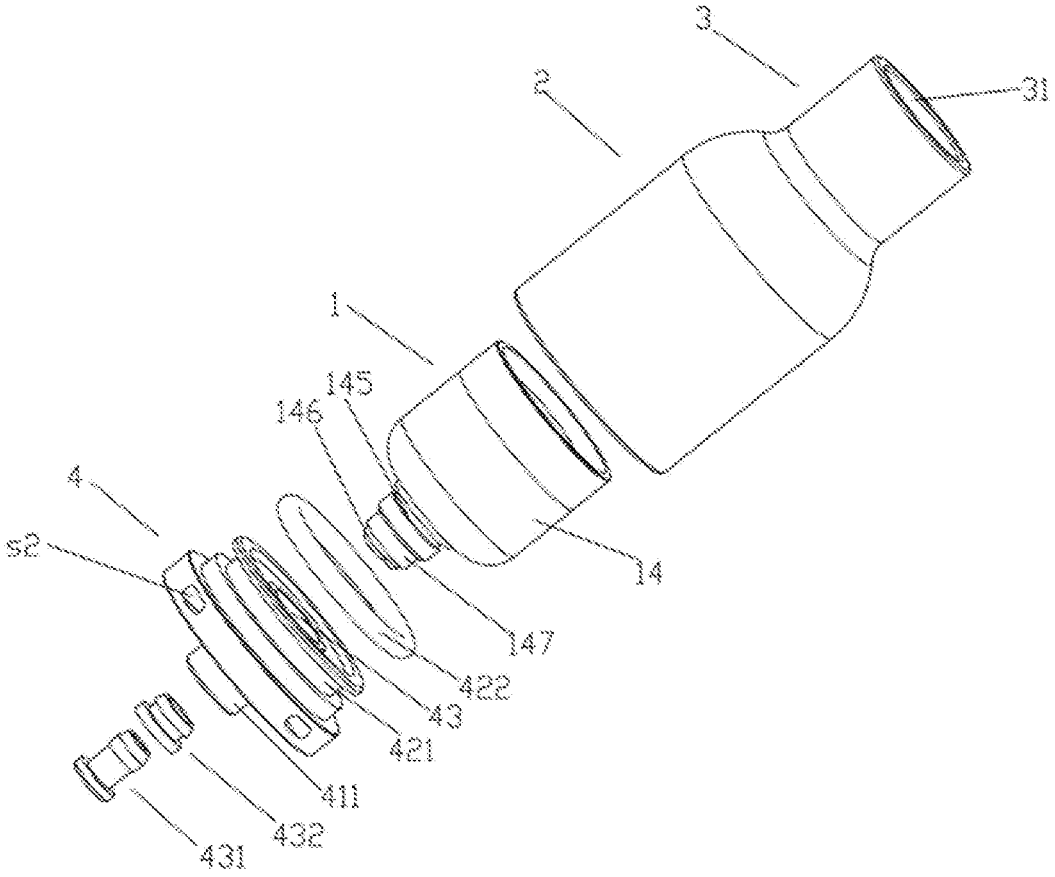
FIG. 4 is an exploded view of an electronic cigarette atomizer according to a third embodiment of the present application.

As shown in FIG. 3 and FIG. 4, an end of the outer casing 2 opposite to the nozzle assembly 3 is further provided with a connecting portion 4 for connecting to the battery assembly, the connecting portion 4 comprises a first connecting portion 41 abutting against an end wall of the outer casing 2, and a second connecting portion 42 inserted into an inner portion of the outer casing 2; a center of the first connecting portion 41 is axially extended in a direction opposite to the nozzle assembly 3 to form a second external electrode 411, and a center of the connecting portion 4 is provided with an accommodating space 43 sequentially penetrating the first connecting portion 41 and the second connecting portion 42; one end of the accommodating space 43 near the second external electrode 411 is provided with a hollow second internal electrode 431, and a second insulating ring 432 is sleeved between the second external electrode 411 and the second internal electrode 431.

Figure 5:
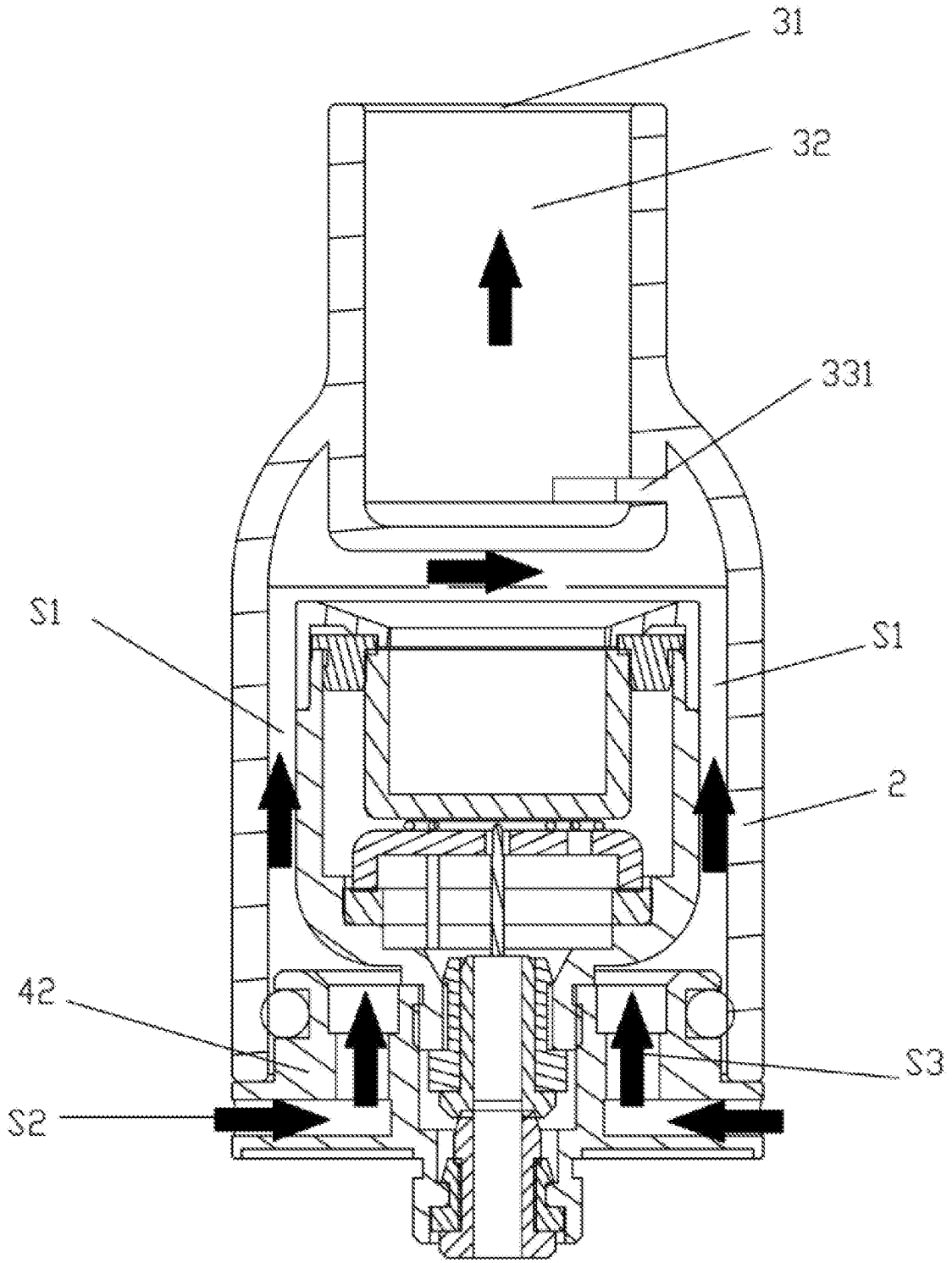
FIG. 5 is a schematic diagram of airflow of an electronic cigarette atomizer according to a third embodiment of the present application.

As shown in FIG. 3 and FIG. 5, in the present embodiment, in order to allow airflow to enter into the airflow passage S1, a side wall of the first connecting portion 41 is provided with a plurality of first air intake passages S2, and an internal portion of the second connecting portion 42 is provided with a plurality of second air intake passages S3 along an axial direction of the outer casing 2. In the embodiment, a side wall of the first connecting portion 41 is uniformly provided with four first air intake passages S2, an internal portion of the second connecting portion 42 is correspondingly provided with four second air intake passages S3 along an axial direction of the outer casing 2, each of the second air intake passages S3 is in communication with each of the first air intake passages S2, and each of the first air intake passages S2, each of the second air intake passages S3, the airflow passage S1, the first chamber 32 and the smoke outlet 31 are sequentially connected. When an airflow sequentially enters the first intake passages S2, the second intake passages S3, and the airflow passage S1, and reaches a upper portion of the e-liquid storage chamber 11, the airflow is mixed with smoke formed by atomization of the e-liquid, and the mixed airflow flows to the first chamber 32 through the vent 331, and finally enters the mouth of an user from the smoke outlet 31, the mixed airflow ensures the atomization efficiency, reduces the irritation and hot burning degree of mouth feel of highly atomized e-liquid, improves user experience. In addition, smoke flowing into the mouth of the user does not pass through the heating wire, effectively avoiding an inhalation of metal ions to affect health of the user.

As shown in FIG. 1 and FIG. 3, an outer side wall of the second connecting portion 42 is provided with an annular groove 421, and a second sleeve ring 422 is elastically clamped in the groove 422, the second sleeve ring 422 is elastically and respectively abutted against the groove 421 and an inner side wall of the outer casing 2 to achieve a fixed connection of the connecting portion 4 and the outer casing 2, and the second sleeve ring 422 is made of an elastically thermal insulation material to facilitate installation and disassembly of the connecting portion 4.

In a specific implementation, the first external electrode 145 of the atomization core is inserted into one end of the accommodating space 43 toward the nozzle assembly 3, the first external electrode 145 is electrically connected to the second external electrode 411, and the first internal electrode 146 of the atomization core is electrically connected to the second internal electrode 431. The second internal electrode 431 and the first internal electrode 146 are both hollow and are communicated with each other, and are communicated with the first space 16 through the first through hole 143. Air in the first space 16 is heated by the heating element 12, and heat can be further transmitted to the e-liquid storage chamber 11 through a side wall of the e-liquid reservoir 15 to improve the atomization efficiency of the e-liquid.

Specifically, the first connecting pin 121 of the heating element 12 of the atomization core is electrically connected to the first external electrode 145 through the first connecting hole 171, and then electrically connected to the second external electrode 411 through the first external electrode 145. The second connecting pin 122 of the heating element 12 is electrically connected to the first internal electrode 146 through the second connecting hole 172, and then electrically connected to the second internal electrode 431 through the first internal electrode 146, thereby avoiding a short circuit occurs when the two connecting wires are brought together by a transportation process or vibration.

Above all, the electronic cigarette atomization core and atomizer of the present solution have following technical effects:

1) By making the heating chamber provided with the heating element and the e-liquid storage chamber accommodating the e-liquid be disconnected to each other, smoke obtained by the atomization is purely soft to improve the user experience and it can prevent the inhalation of metal ions from affecting the health of the user;

2) Cold air is mixed with atomized e-liquid to flow into the mouth of a user, and the taste of smoke is pure while avoiding excessive heat, thereby improving the user experience;

3) By setting the heating element in a spiral shape to increase a contact surface of the heating element and the e-liquid storage chamber, so as to effectively improve atomization efficiency;

4) The e-liquid reservoir is made of a glass material, at the same time of heat conduction, the heat of the heating element can be radiated to the e-liquid in the e-liquid storage chamber by heat radiation, thereby further improving the atomization efficiency and saving energy.

While the present application has been described typical embodiments of the present application, those skilled in the art can make additional changes and modifications to the embodiments as long as they know the creative conception of the present application. Therefore, the appended claims are intended to be interpreted as comprising the typical embodiments and other additions and modifications within a range of the present application.

It will be apparent that those skilled in the art can make various modifications and variations to the present application without departing from the spirit and scope of the present application. Thus, it is intended that the present application comprises such modifications and variations as the modifications and variations are within the scope of the appended claims and technical solutions which is equaled or similar to the appended claims.

The invention claimed is:

1. An electronic cigarette atomization core for atomizing e-liquid to form smoke for a user to inhale, the electronic cigarette atomization core comprising an atomizing core body (1), and the atomizing core body (1) is provided with an e-liquid storage chamber (11) for receiving e-liquid and a heating chamber (13) for accommodating a heating element (12), the heating element (12) is abutted against an outer wall of one end of the e-liquid storage chamber (11) for transferring heat to the e-liquid in the e-liquid storage chamber (11) to atomize the e-liquid when the heating element (12) generates heat, the e-liquid storage chamber (11) and the heating chamber (13) are disconnected to each other; and wherein the atomizing core body (1) further comprises a heat insulating bracket (14) sleeved outside the e-liquid storage chamber (11) and the heating chamber (13) for thermally insulating the e-liquid storage chamber (11) when the heating element (12) generates heat;

wherein an e-liquid reservoir (15) is axially defined in the atomizing core body (1), and the e-liquid storage chamber (11) is formed in the e-liquid reservoir (15), the e-liquid reservoir (15) comprises an open end, and the heating element (12) is in a spiral shape and is abutted against an outer end wall of the e-liquid reservoir (15) opposite to the open end; and wherein an end of the heat insulating bracket (14) opposite to the heating element (12) is an open end and is connected with a first fixing member (141), and one end of the first fixing member (141) is abutted against the e-liquid reservoir (15) and an end wall of an open end of the heat insulating bracket (14), respectively; the other end of the first fixing member (141) is clamped between a side wall of the e-liquid reservoir (15) and a side wall of the heat insulating bracket (14), so that the e-liquid reservoir (15) is spaced apart with the heat insulating bracket (14) to form a first space (16) for thermal insulation, the heating chamber (13) is defined inside the first space (16);

wherein the first fixing member (141) is sleeved by a second fixing member (142), and the second fixing member (142) is respectively abutted against an end wall of the open end of the e-liquid reservoir (15), an outer side wall of the open end of the heat insulating bracket (14), and the first fixing member (141) for fixing the first fixing member (141) between the e-liquid reservoir (15) and the heat insulating bracket (14) and for fixing the e-liquid reservoir (15) inside the heat insulating bracket (14);

an inner wall of the heat insulating bracket (14) is inwardly and radially shrunk to form a limiting step (143), and the limiting step (143) abuts against a first sleeve ring (144).

2. The electronic cigarette atomization core according to claim 1, wherein a support barrel (17) is further defined in an end of the heat insulating bracket (14) opposite to the first fixing member (141), the support barrel (17) comprises an open end and an annular end wall of the open end is abutted against the first sleeve ring (144), an outer end wall of the other end of the support barrel (17) abuts against the heating element (12) to fix the heating element (12) between the support barrel (17) and the e-liquid reservoir (15), the heating chamber (13) is formed between the support barrel (17) and the e-liquid reservoir (15).

3. The electronic cigarette atomization core according to claim 2, wherein the heating element (12) comprises a first connecting pin (121) and a second connecting pin (122) for an electrical connection, a first through hole (173), a first connecting hole (171) and a second connecting hole (172) are defined at the outer end wall of the support barrel (17) abutted against the heating element (12), and the first connecting hole (171) and the second connecting hole (172) are configured to pass through the first connecting pin (121) and the second connecting pin (122), respectively.

4. The electronic cigarette atomization core according to claim 3, wherein one end of the heat insulating bracket (14) opposite to the first fixing member (141) is radially shrunk and axially extended opposite to the first fixing member (141) to form a first external electrode (145), the first external electrode (145) is provided with a first internal electrode (146), a first insulating ring (147) is sleeved between the first external electrode (145) and the first internal electrode (146); and wherein a first connecting pin (121) of the heating element (12) is electrically connected to the first external electrode (145) through the first connecting hole (171), and a second connecting pin of the heating element (12) is electrically connected to the first internal electrode (146) through the second connecting hole (172).

5. An electronic cigarette atomizer, comprising the electronic cigarette atomization core according to claim 1, wherein the atomizer comprises an outer casing (2) sleeved outside the atomization core, a nozzle assembly (3) defined at one end of the outer casing (2), the outer casing (2) is spaced apart with the heat insulating bracket (14) of the atomization core to form an airflow passage (S1) for air to flow, smoke generated by atomization of the e-liquid in the e-liquid storage chamber (11) enters the airflow passage (S1), mixes with air and flows to the nozzle assembly (3);

wherein one end of the nozzle assembly (3) is provided with a smoke outlet (31) and internally provided with a first chamber (32) communicated with the smoke outlet (31), the other end of the nozzle assembly (3) extends axially opposite to the smoke outlet (31) to an internal portion of the outer casing (2) to form an embedding portion (33), a side wall of the embedding portion (33) is provided with a vent (331), and the smoke outlet (31) and the first chamber (32) are communicated with the airflow passage (S1) through the vent (331).

6. The electronic cigarette atomizer according to claim 5, wherein an end of the outer casing (2) opposite to the nozzle assembly (3) is further provided with a connecting portion (4) for connecting to a battery assembly, the connecting portion (4) comprises a first connecting portion (41) abutting against an end wall of the outer casing (2), and a second connecting portion (42) inserted into an inner portion of the outer casing (2); and wherein a center of the first connecting portion (41) is axially extended in a direction opposite to the nozzle assembly (3) to form a second external electrode (411), and a center of the connecting portion (4) is provided with an accommodating space (43) sequentially penetrating the first connecting portion (41) and the second connecting portion (42); a first external electrode (145) of the atomization core is inserted into one end of the accommodating space (43) toward the nozzle assembly (3), the first external electrode (145) is electrically connected to the second external electrode (411), and the first internal electrode (146) of the atomization core is electrically connected to the second internal electrode (431); and wherein one end of the accommodating space (43) near the second external electrode (411) is provided with a second internal electrode (431), and a second insulating ring (432) is sleeved between the second external electrode (411) and the second internal electrode (431).

7. The electronic cigarette atomizer according to claim 6, wherein a side wall of the first connecting portion (41) is provided with a plurality of first air intake passages (S2), and an internal portion of the second connecting portion (42) is provided with a plurality of second air intake passages (S3) along an axial direction of the outer casing (2), each of the second air intake passages (S3) is in communication with each of the first air intake passages (S2), and each of the first air intake passages S2, each of the second air intake passages (S3), the airflow passage (S1), the first chamber (32) and the smoke outlet (31) are sequentially communicated.

8. The electronic cigarette atomizer according to claim 6, wherein an outer side wall of the second connecting portion (42) is provided with an annular groove (421), and a second sleeve ring (422) is elastically clamped in the annular groove (421), the second sleeve ring (422) is elastically and respectively abutted against the annular groove (421) and an inner side wall of the outer casing (2) to achieve a fixed connection of the connecting portion (4) and the outer casing (2).

9. An electronic cigarette atomization core for atomizing e-liquid to form smoke for a user to inhale, the electronic cigarette atomization core comprising an atomizing core body (1), and the atomizing core body (1) is provided with an e-liquid storage chamber (11) for receiving e-liquid and a heating chamber (13) for accommodating a heating element (12), the heating element (12) is abutted against an outer wall of one end of the e-liquid storage chamber (11) for transferring heat to the e-liquid in the e-liquid storage chamber (11) to atomize the e-liquid when the heating element (12) generates heat, the e-liquid storage chamber (11) and the heating chamber (13) are disconnected to each other; and wherein the atomizing core body (1) further comprises a heat insulating bracket (14) sleeved outside the e-liquid storage chamber (11) and the heating chamber (13) for thermally insulating the e-liquid storage chamber (11) when the heating element (12) generates heat;

wherein an e-liquid reservoir (15) is axially defined in the atomizing core body (1), and the e-liquid reservoir (15) comprises an open end, the e-liquid storage chamber (11) is formed in the e-liquid reservoir (15) and adjacent to the open end of the e-liquid reservoir (15), and the heating chamber (13) is formed in the e-liquid reservoir (15) and is positioned opposite to the open end of the e-liquid reservoir (15), a partition plate (151) for isolating the e-liquid storage chamber (11) and the heating chamber (13) is defined in the e-liquid reservoir (15), and the heating element (12) is in a spiral shape and is abutted against an inner end wall of the e-liquid reservoir (15) opposite to the open end.

10. The electronic cigarette atomization core according to claim 9, wherein an inner wall of the heat insulating bracket (14) is inwardly and radially shrunk to form a limiting step (143), and the limiting step (143) abuts against a first sleeve ring (144); and wherein a support barrel (17) is further defined in the heat insulating bracket (14), the support barrel (17) comprises an open end and an annular end wall of the open end is abutted against the first sleeve ring (144), an end wall of the other end of the support barrel (17) partially extends toward the e-liquid reservoir (15) to form an annular projection (174), and the annular projection (174) is abutted against an outer end wall of the e-liquid reservoir (15) opposite to the open end.

11. The electronic cigarette atomization core according to claim 10, wherein the heating element (12) comprises a first connecting pin (121) and a second connecting pin (122) for an electrical connection, a third connecting hole (152) and a fourth connecting hole (153) are provided on an end wall of the e-liquid reservoir (15) opposite to the open end, the third connecting hole (152) and the fourth connecting hole (153) are configured to pass through the first connecting foot (121) and the second connecting foot (122) of the heating element (12), respectively; a fifth connecting hole (175) and a sixth connecting hole (176) are defined at an end wall of the support barrel (17) adjacent to the e-liquid reservoir (15), the fifth connecting hole (175) and the sixth connecting hole (176) are configured to pass through the first connecting pin (121) and the second connecting pin (122) of the heating element (12).

* * * * *